US005134420A

United States Patent [19]

Rosen et al.

[11] Patent Number: 5,134,420

[45] Date of Patent: Jul. 28, 1992

[54] BICONE ANTENNA WITH HEMISPHERICAL BEAM

[75] Inventors: Harold A. Rosen, Santa Monica; Krishnan Raghavan; Mon N. Wong, both of Torrance; Gregory D. Kroupa, Hawthorne, all of Calif.

[73] Assignee: Hughes Aircraft Company, Los Angeles, Calif.

[21] Appl. No.: 520,298

[22] Filed: May 7, 1990

[51] Int. Cl.[5] ..... H01Q 13/04

[52] U.S. Cl. ..... 343/756; 343/771; 343/773

[58] Field of Search ..... 343/756, 771, 773–775

[56] References Cited

U.S. PATENT DOCUMENTS 2,650,985 9/1953 Rust et al. ..... 343/793
2,978,702 4/1961 Pakan ..... 343/773

FOREIGN PATENT DOCUMENTS 3122016 12/1982 Fed. Rep. of Germany ..... 343/773

OTHER PUBLICATIONS

Tang, "Dual Frequency Omnidirectional Slot Antenna", The Microwave Journal vol. 9-No. 12, Dec. 1966 pp. 60–61.

Saito et al., "The NHK Kinuta SHF Experimental Station", NHK Laboratories Note, Ser. No. 182, Oct. 1974, pp. 2–7.

*Primary Examiner*—Michael C. Wimer

*Attorney, Agent, or Firm*—Steven M. Mitchell; Robert A. Westerlund; Wanda K. Denson-Low

[57] ABSTRACT

A bicone microwave antenna having an orthomode tee as an input/output terminal, an internal dielectric polarizer, a circular waveguide with eight longitudinal radiating slots, two 30 degree conical reflectors, an external meanderline polarizer, and a partial circular waveguide short. An RF signal from the input/output terminal is converted into a rotating $TE_{11}$ mode by the internal dielectric polarizer. The radiating slots in combination with the conical reflectors radiate the RF signal as a horizontally polarized field in a doughnut-shaped pattern. The meanderline polarizer converts the horizontally polarized field into a circularly polarized field. The partial circular waveguide short leaks a predetermined amount of radiation out the end of the waveguide to fill the center hole of the doughnut-shaped radiation pattern, thus producing a hemispherical RF beam having an elevation angle from 110 to −110 degrees. The use of impedance-matching circular rings in the waveguide further enhances the ability of the antenna to operate in three frequency bands.

20 Claims, 3 Drawing Sheets

32
16
30
31
5
5

33
34
36
31
45°
33
35
36
35

25
14
24
27
26
22

7
7
23
23
26
14
22

12
SEE FIG. 2
56
56
54
50
48
46
20
52
42
56
56
18
41
40

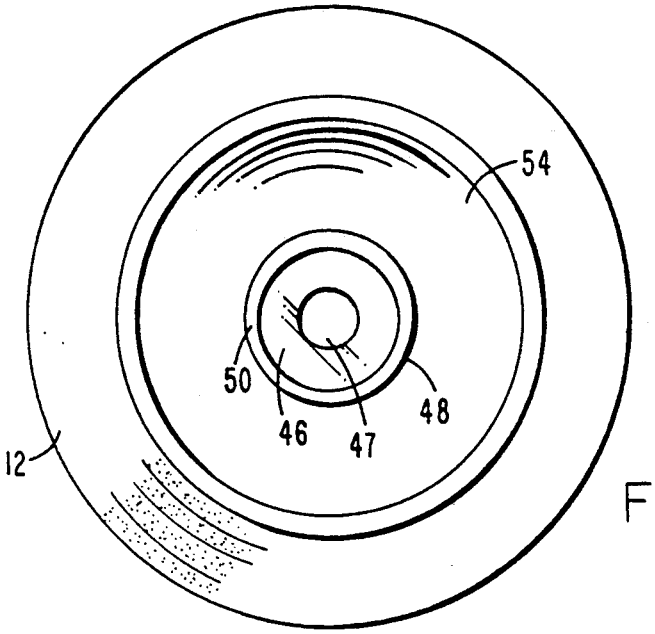
Fig. 9.
Fig. 8.
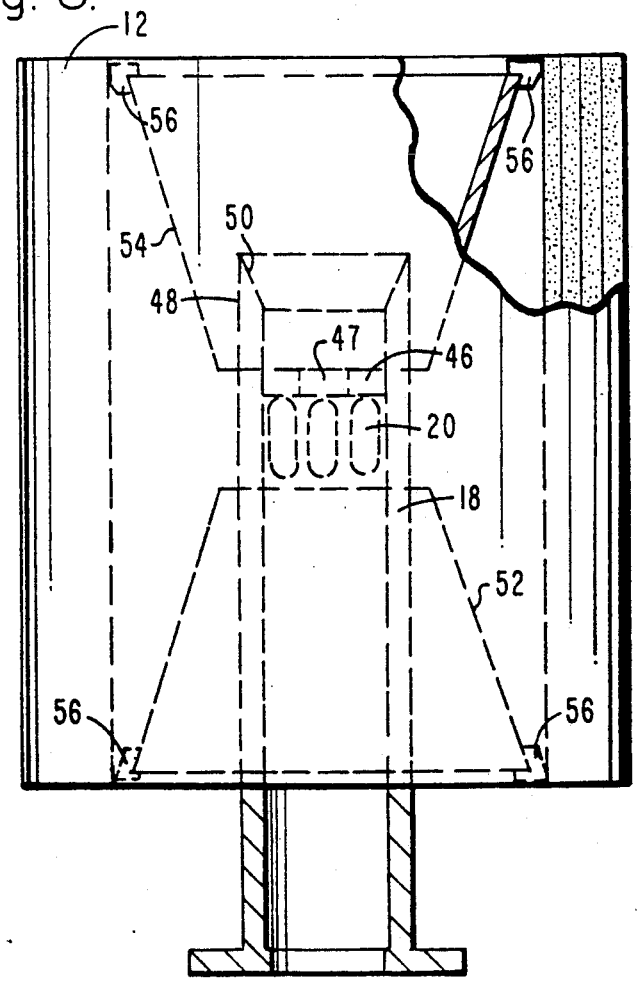

BICONE ANTENNA WITH HEMISPHERICAL BEAM

BACKGROUND

The present invention relates to microwave antennas and, more particularly, to a telemetry and command antenna suitable for use on three-axis stabilized satellites.

The telemetry and command antennas employed on satellites heretofore have an elevation coverage angle that is too narrow. For example, the conventional end-fired dielectric rod antenna has a maximum elevation coverage angle of −90° to +90°. The telemetry and command antenna used on the Leasat satellite is a bicone antenna that operates in the circularly polarized mode. However, the Leasat telemetry and command bicone antenna provides only omnidirectional coverage and does not provide hemispherical coverage. The telemetry and command antenna employed on the Satellite Business Systems (SBS) satellite is also a bicone antenna but it operates only in the linearly polarized mode, and does not operate in the circularly polarized mode. Furthermore, the frequency bandwidth of conventional antennas is only about 2% of the center frequency. Typically, the telemetry and command antennas are not used both for transmitting and receiving. Instead, separate transmit and receive antennas are used.

Accordingly, it is an objective of the present invention to provide a circularlypolarized Ku-band telemetry and command bicone antenna that operates at three frequency channels. Another objective of the invention is to provide a telemetry and command bicone antenna that provides a wide elevation angle of coverage. A further objective of the present invention is to provide a bicone antenna having a hemispherical beam that is suitable for use on a three-axis stabilized satellite such as the Aussat B satellite.

SUMMARY OF THE INVENTION

In accordance with these and other objectives and features of the invention, there is provided a microwave antenna comprising an orthomode tee as the input/output terminal, an internal dielectric polarizer, a circular guide with eight longitudinal radiating slots, a partial circular waveguide short circuit, two 30° conical reflectors, and an external meanderline polarizer. The orthomode tee has two ports, and an RF signal may be launched at either port to obtain one sense of circular polarization. Dual mode circular polarization may be excited at the same time because the electric fields of the RF signals at the two ports are perpendicular. Hence, the two RF fields are isolated from each other.

The dielectric polarizer generates a rotating $TE_{11}$ mode RF field in the circular waveguide which excites the eight radiating linear slots equally and sequentially at its RF frequency rate. A horizontally-polarized field is propagated radially outward from the slots. The partial circular guide short circuit is placed at a quarter wavelength from the centerline of the slots. The partial short circuit permits a predetermined amount of circularly polarized RF power to radiate out at the end of the circular waveguide. A short phasing section of circular waveguide is attached adjacent to the partial circular short circuit. Its purpose is to delay the signal radiated out the end of the circular guide so that it will add in phase with the signal from the slots at their joint angles. Two conical reflectors are disposed adjacent the slots.

Dielectric supports mount an external meanderline polarizer to the conical reflectors. The five-layer meanderline polarizer converts the horizontally polarized field from the slots into a circularly polarized field and forms a toroidal or doughnut shaped RF pattern. The energy leaked out of the end of the circular waveguide through the circular guide short circuit fills up the center hole of the doughnut shaped RF pattern. The resultant RF pattern is a hemispherical beam.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which:

FIGS. 3–7 taken together comprise an exploded view of the bicone antenna shown in FIG. 1;

FIG. 3 shows a cutaway side view of the slotted waveguide of the bicone antenna of FIG. 1 showing how the meanderline polarizer of FIG. 2 mounts thereon;

FIG. 4*a* shows a side view of the dielectric polarizer employed in the bicone antenna of FIG. 1;

FIG. 4*b* is a side view of a dielectric polarizer element that is mounted within the dielectric polarizer shown in FIG. 4*a*;

FIG. 5 is a bottom view of the dielectric polarizer of FIG. 4*a* taken along the line 5—5 of FIG. 4*a* looking into the interior of the dielectric polarizer and showing the dielectric polarizer element of FIG. 4*b* therein;

FIG. 6 shows a side view of the orthomode tee employed as part of the bicone antenna of FIG. 1;

FIG. 7 is a bottom view of the orthomode tee of FIG. 6 taken along the line 7—7 of FIG. 6 looking into the interior of the orthomode tee;

FIG. 8 is a side view of the top of the antenna of FIG. 1 showing details of the radiating elements; and FIG. 9 is a top view of the antenna shown in FIG. 8 showing details of a partial guide short circuit and a short phasing section of waveguide.

DETAILED DESCRIPTION

Figure 1:
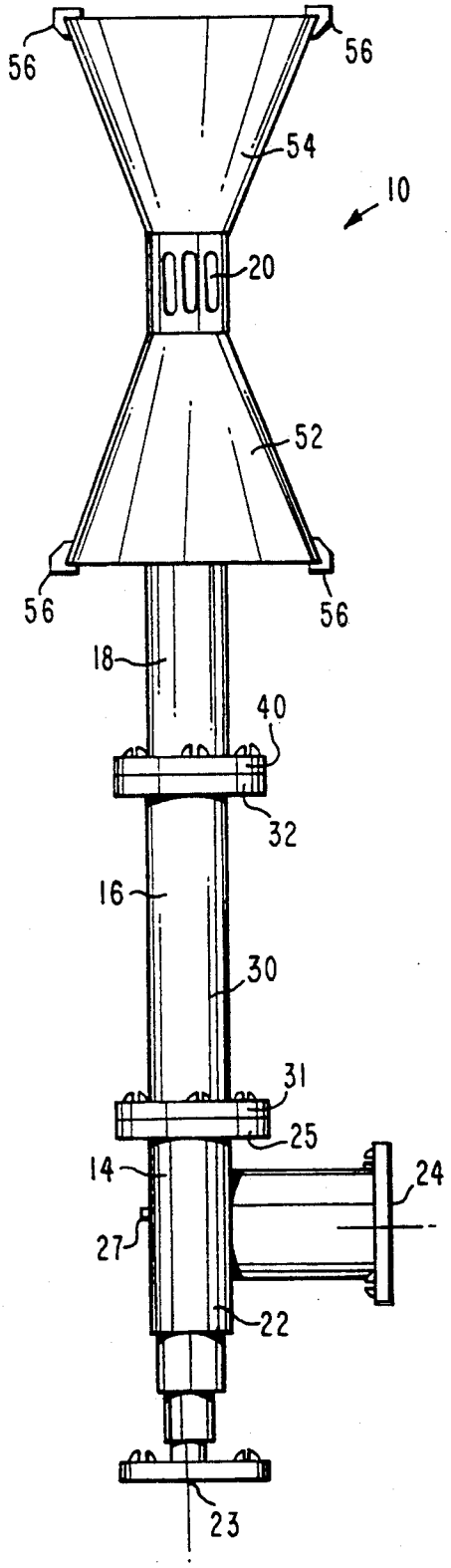
FIG. 1 shows a side view of a bicone antenna in accordance with the principles of the present invention comprising an orthomode tee, a dielectric polarizer, and a circular waveguide having slots.
Figures 3, 4A, 4B, 5, 6, 7:
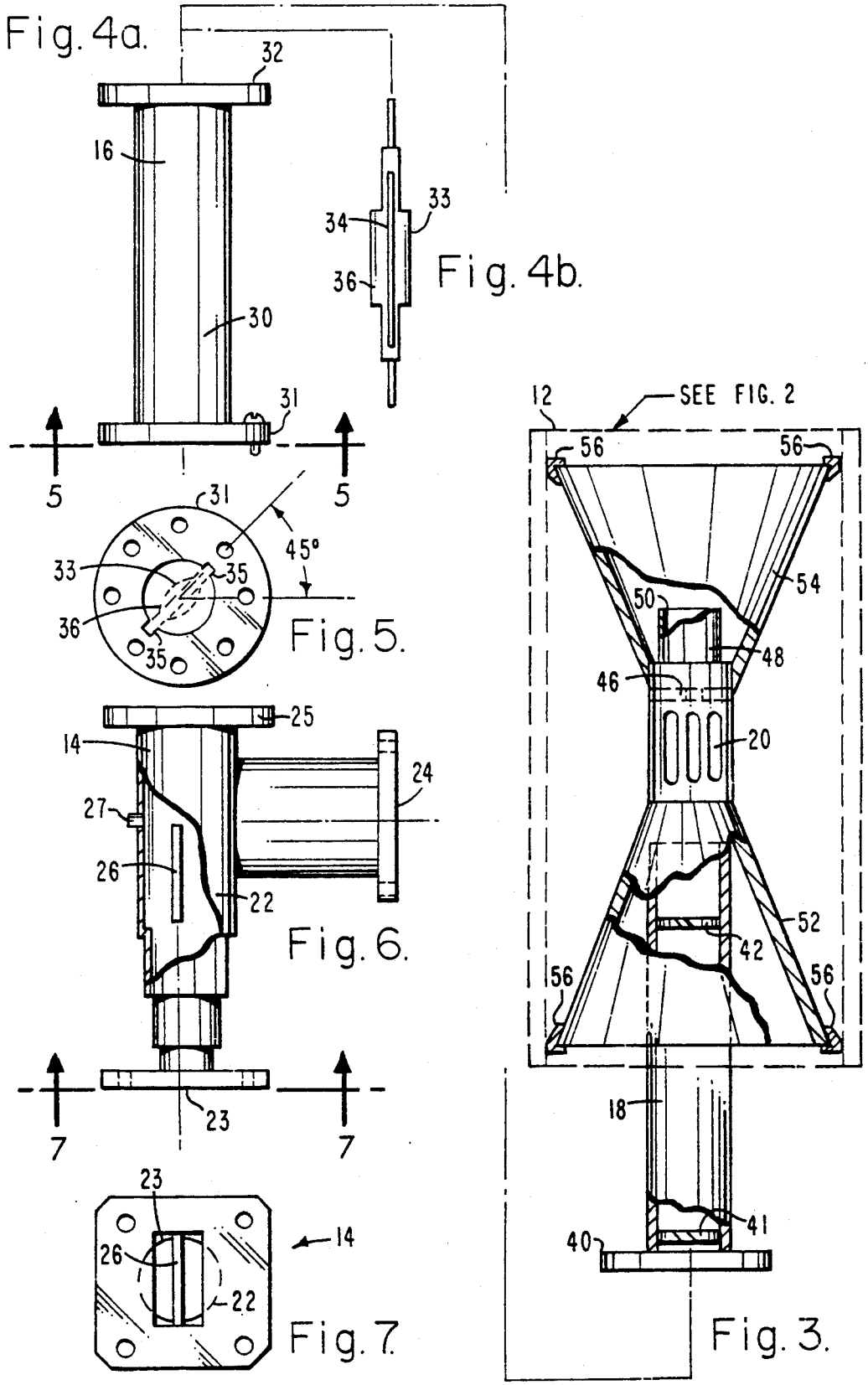

Referring now to the drawings, FIG. 1 shows a side view of a completely assembled bicone antenna 10 except for one part removed for clarity. The removed part is a meanderline polarizer 12 shown in perspective in FIG. 2. The upper part of the antenna 10 is shown in FIG. 3 with the meanderline polarizer 12 in phantom installed in place. The bicone antenna 10 of FIG. 1 comprises an orthomode tee 14 coupled to a dielectric polarizer 16 which is in turn coupled to a circular waveguide 18 having eight slots 20. FIGS. 3–7 taken together comprise an exploded view of the bicone antenna 10, wherein FIGS. 6 and 7 show the orthomode tee 14, FIGS. 4 and 5 show the dielectric polarizer 16, and FIG. 3 shows the circular waveguide 18 having the meanderline polarizer 12 installed over the slots 20.

Referring now to FIG. 1 taken in conjunction with FIG. 6 and FIG. 7, the orthomode tee 14 comprises a section of circular waveguide 22 provided with a first rectangular input port 23 at the bottom, and a second rectangular input port 24 at the side. The two input ports 23, 24 are short sections of WR-75 rectangular waveguide that are disposed orthogonally with respect to each other. The circular waveguide 22 is 0.692 inch diameter in the exemplary embodiment of the present invention, which is 0.583 of the operating wavelength. The upper end of the circular waveguide 22 terminates in a waveguide flange 25 by which the orthomode tee 14 is attached to the rest of the antenna 10.

As may be seen in FIGS. 6 and 7, the interior of the orthomode tee 14 is provided with a blade short 26 extending down the center of the circular waveguide 22. The blade short 26 in the present embodiment is a thin piece of sheet metal 0.820×0.032 inches. The blade short 26 extends from the middle of the second rectangular input port 24 to the bottom of the waveguide 22. The blade short 26 is oriented with respect to the orientation of the orthogonal rectangular input ports 23, 24 such that it is adapted to be transparent to a wave entering the first input port 23. The blade short 26 is adapted to present a short circuit to a wave entering the second rectangular input port 24 if it attempts to travel toward the first port 23. A wave entering the second port 24 is unimpeded if it travels up the circular waveguide 22 toward the waveguide flange 25. In FIG. 6 there may be seen a screw 27 extending from the wall of the waveguide 22 on the side opposite to the second input port 24. This screw 27 is adjustable to compensate for the presence of the second port 24 in the wall of the waveguide 22 so that waves from the first port 23 are not presented with a discontinuity in the field as they propagate upward toward the flange 25.

Referring now to FIG. 1 taken in conjunction with FIG. 4*a* and FIG. 5, the dielectric polarizer 16 comprises a section of circular waveguide 30 having a waveguide flange 31 at the bottom and another waveguide flange 32 at the top. The bottom waveguide flange 31 is connected to the waveguide flange 25 of the orthomode tee 14. Referring to FIG. 4*b* and FIG. 5, inside the waveguide 30 there is disposed a dielectric polarizer element 33. As may best be seen in FIG. 5, the dielectric polarizer element 33 comprises a flat member 34 held in slots 35 in the walls of the waveguide 30. A dielectric material 36 is disposed on the flat member 34. In the present exemplary embodiment, the dielectric material 36 is made of ULTEM-1000 manufactured by the General Electric Co. As may be seen in FIG. 5, the plane of the flat member 34 is rotated 45° with respect to the plane of the blade short 26 in the orthomode tee 14.

Referring now to FIG. 1 taken in conjunction with FIG. 3, the circular waveguide 18 with the eight slots 20 is provided with a waveguide flange 40 that connects to the waveguide flange 32 at the upper end of the dielectric polarizer 16. First and second impedance matching rings 41, 42 are disposed within the waveguide 18. The first ring 41 is disposed near the waveguide flange 40, and the second ring 42 is near the center of the waveguide 18. The first impedance matching ring 41 in the present embodiment is 0.095 inch thick, annular in shape, and 0.250 inch in width. The second impedance matching ring 42 is 0.050 inch thick, annular in shape and 0.0250 inch in width. The size and the position of the rings 41, 42 is first experimentally determined and then they are fastened in place as by soldering, for example.

The eight radiating slots 20 are disposed near the upper end of the circular waveguide 18. The slots 20 are one half wavelength long (0.45 inch) and 0.06 inch wide. They are distributed evenly around the circumference of the waveguide 18. Referring now to FIGS. 8 and 9, a partial circular guide short circuit 46 is placed at a quarter wavelength above the centerline of the slots 20. This partial short circuit 46 is annular in shape and in the present exemplary embodiment, is provided with a circular opening 47 of 0.35 inch in diameter although the diameter typically may vary from 0.3 to 0.4 inches. A short phasing section of circular waveguide 48 is attached adjacent to the partial short circuit 46. The phasing section of circular waveguide 48 is about 0.7 inches long, and is provided with a flare aperture 50.

Figure 2:
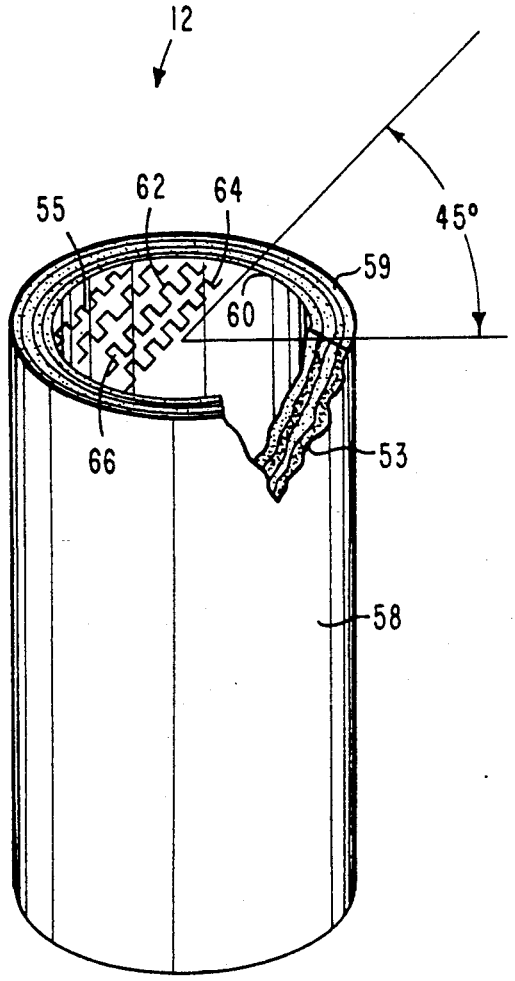
FIG. 2 shows a perspective view of a cylindrical meanderline polarizer for use with the bicone antenna of FIG. 1.

Referring now to FIGS. 1, 3, 8 and 9, the bicone antenna 10 is provided with two 30 degree conical reflectors 52, 54 extending axially along the circular waveguide 18 in opposite directions away from the slots 20. The conical reflectors 52, 54 may have a cone vertical angle in the range between 25 and 40 degrees. Both conical reflectors 52, 54 are attached to the outside of the waveguide 18 adjacent to the slots 20. From the point of attachment, both conical reflectors 52, 54 flare away from the slots 20. The outer diameter of the two 30 degree conical reflectors 52, 54 is 2.57 inch in the present embodiment, which is 3.05 wavelengths at the center frequency operating wavelength. Each of the 30 degree conical reflectors 52, 54 is provided with four dielectric supports 56 spaced at intervals around the outer rim. The external meanderline polarizer 12 of FIG. 2 is mounted to the bicone antenna 10 by means of these dielectric supports 56.

The meanderline polarizer 12 is constructed of five layers of etched copper meanderlines 55 on Kapton sheets 53. The material of the plastic sheets 53 is Kapton Polyimide, having a layer of copper foil. The layers are rolled into coaxial cylinders 58. The smallest such cylinder 58 is 2.83" in diameter and the largest one 3.78" in diameter. Each individual cylinder 58 is separated from the adjacent layer by a honeycomb spacer 59. The spacing between adjacent cylinders is 0.130"±6%.

The meanderlines 55 are oriented at an angle 45 degrees with respect to the edges 60 of the rectangular sheets from which the cylinders 58 are formed. Each meanderline 55 comprises first and second sections 62, 64 of straight lines to form a line of square teeth 66 along the meanderline 55. The first sections 62 of straight lines are oriented parallel to the meanderline 55, and they are 0.04"±5% long and 0.0208"±5% wide. The second sections 64 of straight lines are oriented perpendicular to the meanderlines 55, and they are 0.104"±6% long and 0.0117"±6% wide. The centerlines of adjacent meanderlines 55 are spaced at a distance 0.386"±6% apart.

In general on transmit; a Ku band radio frequency signal is launched either at the first or second port 23, 24 of the orthomode tee 14 to obtain one sense of circular polarized radiation. Dual mode circular polarization may be excited simultaneously, if desired. The first and second ports 23, 24 are isolated because electric fields propagated therein are perpendicular to each other. Waves from the orthomode tee 14 enter the dielectric polarizer 16 and generate a rotating $TE_{11}$ mode that propagates up the circular waveguides 30, 18 to the slots 20. Thus, all of the eight radiating linear slots 20 are excited equally and sequentially at the radio frequency rate. A horizontally polarized field is propagated radially outward from each half wavelength slot 20 toward the five layer meanderline polarizer 12 which provides a −90° shift.

FIG. 1 shows the bicone antenna 10 with the cylindrical meanderline polarizer 12 removed to reveal the slots 20 and conical reflectors 52 and 54 which would normally be hidden inside the cylindrical meanderline polarizer 12. FIG. 3 shows the positioning of the cylindrical meanderline polarizer 12 with respect to the rest of the bicone antenna 10. The purpose of the cylindrical meanderline polarizer 12 is to convert the horizontally polarized RF signal from the slots 20 into a circularly polarized signal and form the RF signal from the slots 20 into a doughnut shaped RF pattern.

In order to achieve a hemispherical beam, part of the input RF energy is radiated out the upper end of the circular waveguide 18. For this purpose, the partial circular guide short circuit 46 is disposed one quarter wavelength above the center line of the slots 20. The partial circular guide short circuit 46 allows a proper amount of circularly polarized RF power to be leaked out to fill up the center hole of the doughnut shaped RF pattern. The resultant RF pattern is a hemispherical beam. The beam extends from the vertical axis along the circular waveguide 18 down to the right 110° and down to the left 110°. To state it another way, the antenna 10 of the present invention achieves a wide elevation angle of coverage: from −110° to 110°, with zero degrees being along the axis of the waveguide 18.

The short phasing section of circular waveguide 48 having the flare aperture 50 is disposed adjacent the partial short circuit 46 for the purpose of delaying the signal leaked out of the 0.35 inch diameter opening 47 so that it adds in phase with the signal from the slots 20 at their joint angles. The operation has been described with respect to the transmit mode, but the antenna 10 works well on receive, also. The antenna 10 operates in the Ku band on three frequency channels: 12.75 GHz, 14.0 GHz and 14.5 GHz. Normally, the 14.0 GHz and 14.5 GHz channels are used for receive channels. Each channel has 100 MHz of frequency bandwidth. The antenna 10 is enabled to achieve such wideband performance by, among other things, using the circular impedance matching rings 41, 42. The five layer meanderline polarizer 12 enables the antenna 10 to provide a low RF axial ratio.

Thus there has been described a new and improved telemetry and command antenna suitable for use on three-axis stabilized satellites. It is to be understood that the above-described embodiment is merely illustrative of some of the many specific embodiments which represent applications of the principles of the present invention. Clearly, numerous and other arrangements can be readily devised by those skilled in the art without departing from the scope of the invention.

What is claimed is:

1. A bicone antenna adapted to provide for transmission and reception of radio frequency signals over a full hemisphere of angular coverage, said antenna comprising:

a circular waveguide having a first end and a second end;

an input/output port disposed at the first end;

a dielectric polarizer disposed within the circular waveguide near the first end;

a plurality of radiating slots disposed evenly around the circumference of the circular waveguide near the second end;

first and second conical reflectors disposed coaxially along the waveguide attached to the outside of the waveguide adjacent to and extending away from the slots;

a plurality of dielectric supports disposed along the outer edges of the conical reflectors;

a cylindrical meanderline polarizer disposed coaxially along the waveguide, disposed around the conical reflectors, and separated from the outer edges of the conical reflectors by the plurality of dielectric supports; and a partial circular guide short disposed near the second end of the waveguide approximately λ4 above the centerline of the plurality of radiating slots.

2. The antenna according to claim 1 wherein the input/output port is an orthomode tee input/output terminal.

3. The antenna according to claim 1 wherein the slots are substantially onehalf wavelength in length.

4. The antenna according to claim 1 wherein the conical reflectors have a cone vertical angle ranging between 25 and 40 degrees.

5. The antenna according to claim 1 wherein the meanderline polarizer comprises a plurality of conducting metal meanderlines disposed on a plurality of layers of cylindrically shaped copper coated insulating plastic.

6. The antenna according to claim 1 wherein the partial circular guide short has an opening with a diameter between 0.3 and 0.4 inches.

7. The antenna according to claim 1 wherein the partial circular guide short is annular in shape.

8. The antenna according to claim 1 further comprising circular rings disposed in the waveguide to provide for impedance matching.

9. The antenna according to claim 1 further comprising a relatively short section of circular waveguide disposed at the second end to delay the signal through the partial guide short.

10. An antenna for transmitting and receiving radio frequency signals over a wide range of directions, said antenna comprising:

a waveguide having first and second ends;

an input/output port disposed at the first end;

a plurality of slots disposed near the second end;

an opening disposed at the second end;

a dielectric polarizer disposed within the circular waveguide near the first end;

first and second conical reflectors, disposed coaxially along the waveguide, attached to the outside of the waveguide adjacent to and extending away from the slots;

a cylindrical meanderline polarizer disposed coaxially along the waveguide, disposed around the conical reflectors; and a partial circular guide short disposed near the second end of the waveguide approximately λ4 above the centerline of the plurality of slots.

11. The antenna according to claim 10 wherein the waveguide is round in cross section.

12. The antenna according to claim 11 wherein the slots are evenly spaced around the circumference of the waveguide.

13. The antenna of claim 10 wherein the meanderline polarizer comprises a plurality of layers of insulating plastic having a plurality of conducting metal meanderlines disposed thereon.

14. The antenna of claim 13 wherein the plastic is polymide and the metal is copper.

15. The antenna of claim 13 wherein the meanderline comprises a plurality of sections of straight lines arranged to form a line of square teeth along the meanderline.

16. The antenna of claim 15 wherein the sections of straight lines parallel to the direction of the meanderline have a length A/2 of 0.04"±5%, and a width W2 of 0.0208"±5%.

17. The antenna of claim 15 wherein the sections of straight lines perpendicular to the direction of the meanderline have a length H of 0.104"±6%, and a width W1 of 0.0117"±6%.

18. The antenna of claim 13 wherein the meanderlines are parallel, and are separated from each other by a distance B of 0.386"±6%.

19. The antenna of claim 13 wherein the layers of plastic are spaced apart by a distance of 0.130"±6%.

20. The antenna of claim 13 wherein the meanderlines are oriented at an angle approximately 45 degrees with respect to the direction of polarization for a linearly polarized signal.

* * * * *

UNITED STATES PATENT AND TRADEMARK OFFICE

CERTIFICATE OF CORRECTION

PATENT NO. : 5,134,420

DATED : July 28, 1992

INVENTOR(S) : Harold A. Rosen, et al.

It is certified that error appears in the above-identified patent and that said Letters Patent is hereby corrected as shown below:

Column 1, line 30, there should be a space between the words "circularly" and "polarized".

Column 6, line 16, delete "$\lambda$4", and insert instead --$\lambda$/4--.

Column 6, line 60, delete "$\lambda$4", and insert instead -- $\lambda$/4--.

Signed and Sealed this

Fourteenth Day of September, 1993

*Attest:*

Bruce Lehman

BRUCE LEHMAN

*Attesting Officer*

*Commissioner of Patents and Trademarks*